US006126503A

United States Patent [19]

Viale et al.

[11] Patent Number: 6,126,503

[45] Date of Patent: Oct. 3, 2000

[54] SWIMMING FLIPPER

[75] Inventors: Mario Viale, Chiavari; Giovanni Garofalo, Rapallo, both of Italy

[73] Assignee: HTM Sport S.p.A., Italy

[21] Appl. No.: 09/431,775

[22] Filed: Nov. 2, 1999

[30] Foreign Application Priority Data

Nov. 4, 1998 [IT] Italy ..... GE98A0090
Jan. 20, 1999 [IT] Italy ..... GE99A0008

[51] Int. Cl.[7] ..... A63B 31/08
[52] U.S. Cl. ..... 441/64
[58] Field of Search ..... 441/60–64; D21/239

[56] References Cited

U.S. PATENT DOCUMENTS 3,171,142 3/1965 Auzols .
3,256,540 6/1966 Novelli .
4,209,866 7/1980 Loeffler .
5,522,748 6/1996 Cressi ..... 441/64
5,595,518 1/1997 Ours ..... 441/64

FOREIGN PATENT DOCUMENTS 1 208 636 2/1960 France .
1 075 997 2/1960 Germany .

*Primary Examiner*—Ed Swinehart
*Attorney, Agent, or Firm*—Larson & Taylor, PLC

[57] ABSTRACT

Swimming flipper consisting of: a shoe made of a relatively soft material and equipped with a sole made of a stiffer material, said shoe being laterally and frontally provided with at least two protruding elements, and a blade whose base is hinged to the sole of the shoe in an area between said protruding elements by means of two extensible elements, said protruding elements being suitable to hit against the upper surface of the blade.

9 Claims, 14 Drawing Sheets

SWIMMING FLIPPER

BACKGROUND OF THE INVENTION

The present invention relates to swimming flippers, and in particular to flippers substantially consisting of a blade and a shaped shoe, said shaped shoe being made of an elastomeric material, rubber for instance, and said blade being made of a harder material, for instance of thermosetting resin with high values of hardness and mechanical resistance.

It is known that while swimming the scuba diver substantially makes with each flipper, synchronously and continuously, two kinds of movement or flipping: a movement down-up with respect to the water surface, i.e. the active flipping, which begins with the flipper having a strong inclination with respect to said surface, and a movement up-down, i.e. the passive flipping, which begins with the flipper being almost parallel to the water surface. Moreover, in the active flipping going upwards the lower surface of the flipper blade acts onto the water mass in touch with it and thus ensures a good forward thrust for the scuba diver, whereas in the passive flipping going downwards it is the upper surface or back of the blade which acts on the water mass in touch with it and substantially under it, said blade being located, as was said before, in an almost parallel position to the water surface, so that the forward thrust at this stage is rather limited.

From U.S. Pat. No. 3,171,142 a swimming flipper is known comprising a shoe provided with a sole to which a flexible blade is secured, and further comprising two pairs of abutment rods secured to said sole and disposed longitudinally each on one side of said blade for limiting the amplitude of the stroke of the blade. The described device is very difficult to be mounted on a swimming flipper.

From U.S. Pat. No. 2,343,468 a propulsion device for swimmers is known, which is very similar to the device of U.S. Pat. No. 3,171,142 previously mentioned. This device is even more unpractical than the device described in U.S. Pat. No. 3,171,142.

From U.S. Pat. No. 3,256,540 a swimming flipper is known comprising a shoe element and a blade element. According to said prior art patent, the shoe element is hinged at the heel region to the blade element, and flexible tie means are provided between shoe and blade for limiting the angular stroke of the blade with respect to the shoe. Again, this device is very difficult to be realized.

SUMMARY OF THE INVENTION

Aim of the present invention is then to realize a swimming flipper which overcomes the disadvantages of the prior art flippers making less hard for the diver and more effective from the dynamic point of view both the passive flippering and the active flippering, in particular guaranteeing to the flipper blade, at the beginning of the active flippering, a greater inclination as to the water surface of the one of the traditional flippers blades and then a more effective push forward.

Such aim is reached according to an embodiment form of the present invention through a swimming flipper including a light shoe of relatively soft material with sole of stiffer material, provided in the front and on the side of at least two projecting elements, and a blade hinged in connection with its root to the sole of the light shoe in a zone between said projecting elements through two stroke-limiting elements, the whole in a way such that:

in the passive flippering from up to down as to the water surface said blade rotates as to the light shoe sole under the action of the water mass in contact with the back of said blade, said rotation being limited by the maximum extension of said stroke-limiting elements;

in the active flippering from down to up as to the water surface said blade rotates as to the light shoe sole under the action of the water mass in contact with the lower surface of said blade, said rotation being limited again by the maximum extension of said stroke-limiting elements.

According to one embodiment of the present invention, the said stroke-limiting elements are in the form of flexible diaphragms.

According to a further embodiment of the present invention, the said flexible diaphragms are replaced by blade support tie rods.

According to still another embodiment of the present invention the said stroke-limiting elements are in the form of membranes or alternatively flexible rods for the supporting of the blade.

BRIEF DESCRIPTION OF THE DRAWINGS

The present invention will be better understood by means of the following description of some preferred embodiments of same, shown by way of non limiting examples in the enclosed drawings, where.

DESCRIPTION OF THE PREFERRED EMBODIMENTS OF THE INVENTION

Figure 1:
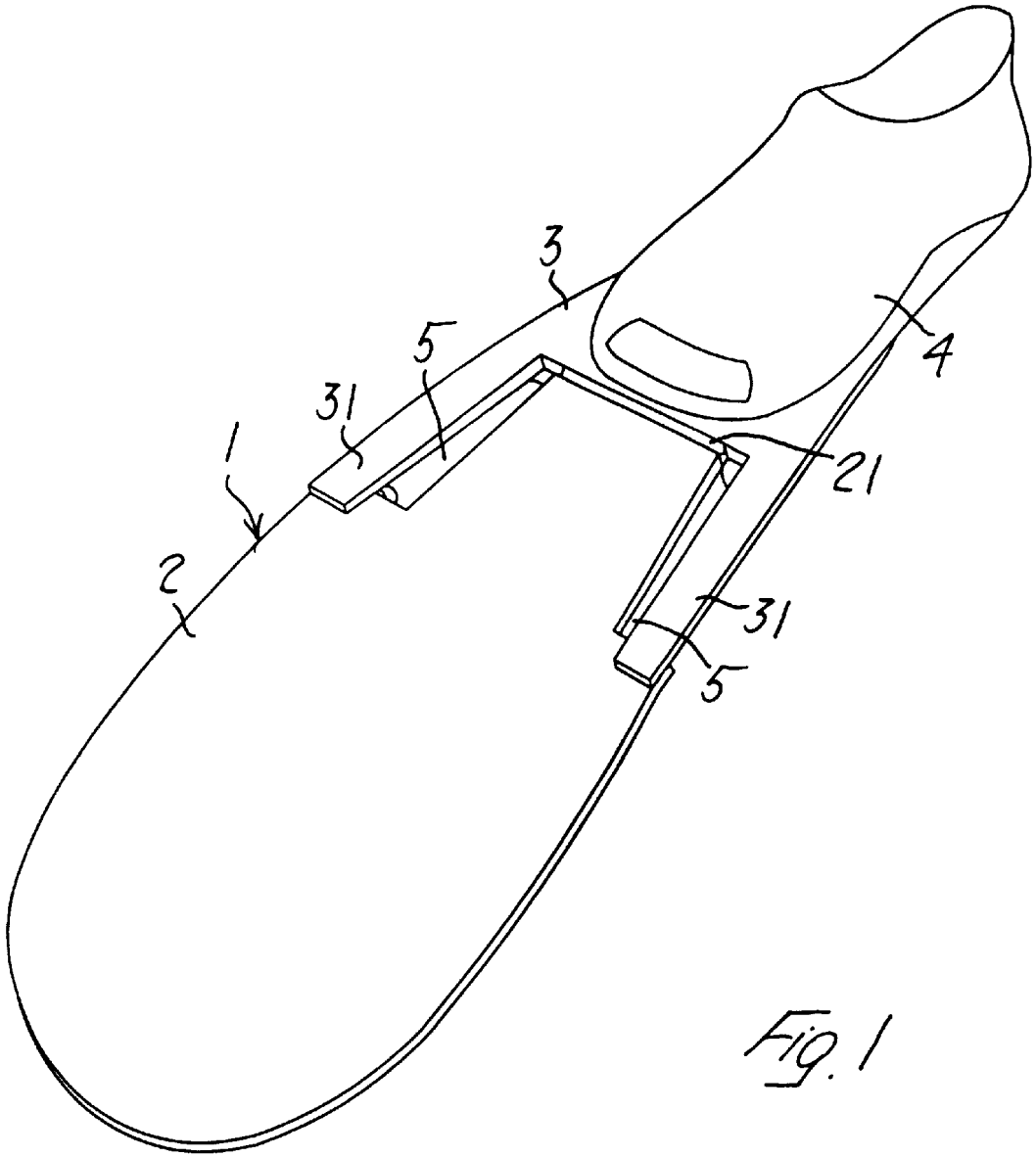
FIG. 1 is a perspective view of a first of embodiment of the swimming blade of the present invention, with the flexible diaphragms in rest position, said diaphragms constituting a lateral link between the blade and the protruding elements of the shoe sole.

With reference to the drawings, and with particular reference to FIG. 1, the swimming flipper 1 shown comprises: a blade 2, made of thermosetting material with high mechanical resistance, a sole 3 usually made of the same material as the blade 2, and a shaped shoe 4 made of a soft elastomeric material, rubber for instance. From the front part of the sole 3 two protruding elements 31 extend laterally, whose ends partially cover the upper portion of the blade 2, so as to provide a shoulder surface for the upper surface of said blade 2, as will be later shown with more details. As it is possible to observe, the protruding elements 31 thus form a wide opening, almost U-shaped, with the portion of sole 3 from where they protrude. Each of the lower surfaces of said protruding elements 31 is linked to the first two ends of two flexible diaphragms 5, the other two ends being linked to the lower surface of the blade 2. Said blade 2, moreover, is hinged to the sole of the shoe 4 along the central area of its base by means of an elastic joint 21, made for instance of rubber or of any other elastomeric material.

Figure 2:
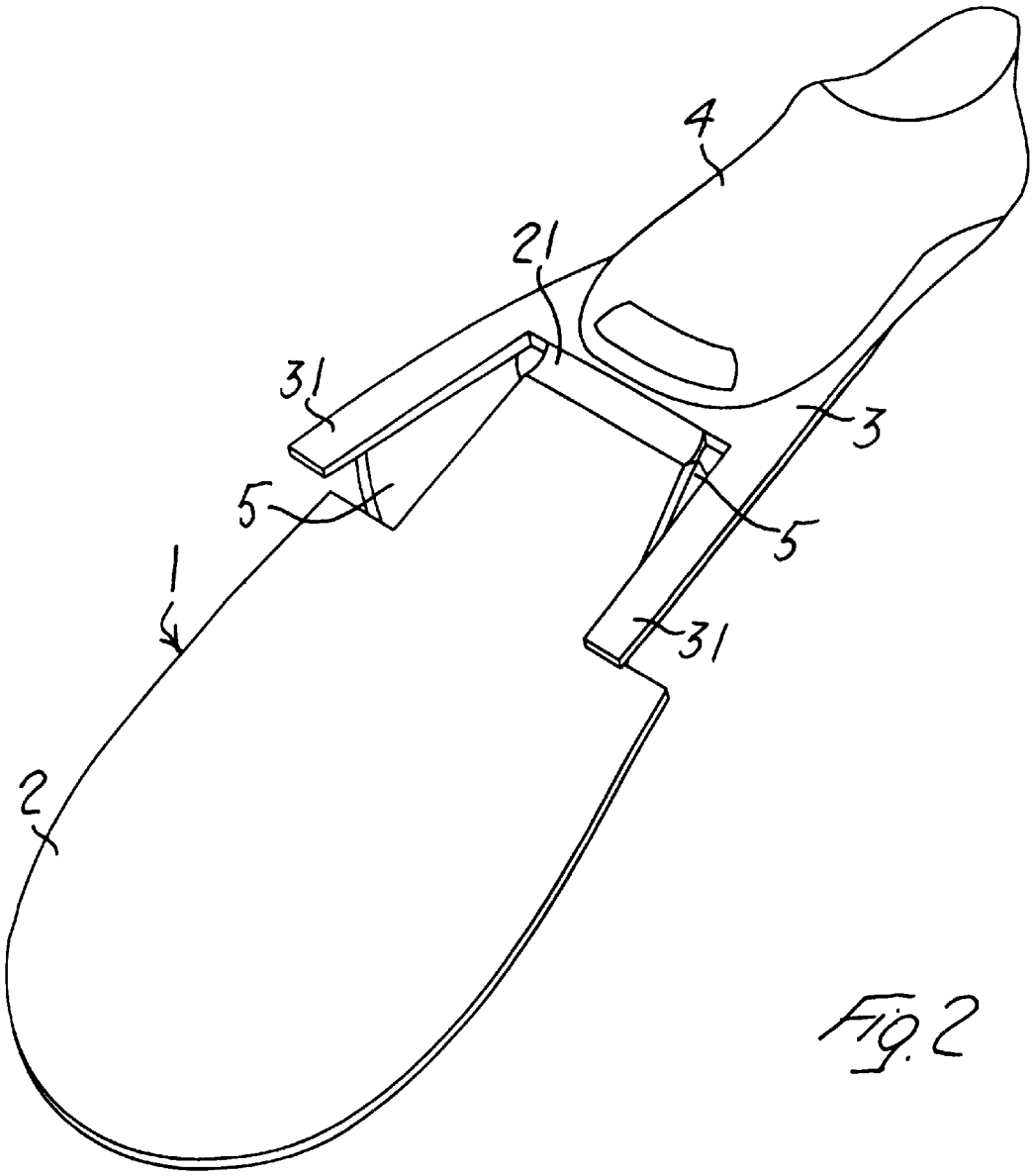
FIG. 2 is a perspective view of the embodiment of FIG. 1 with said flexible diaphragms in the position of maximum extension.

These flexible diaphragms 5, shown in FIG. 2 in their condition of maximum extension, determine the maximum rotation of the blade 2 with respect to the sole 3 of the shoe 4 and, therefore, the maximum deformation of the elastic joint 21. As a matter of fact, the rotation arch drawn by the blade 2 with respect to the sole 3 must not be too wide, so as not to compromise the efficiency of the blade 2 during the passive flipping.

According to a feature of the present invention, said elastic joint 21 and said flexible diaphragms 5 are obtained by injecting the material of the shoe 4, which can be for instance an elastomeric material, like rubber or other.

Figure 3:
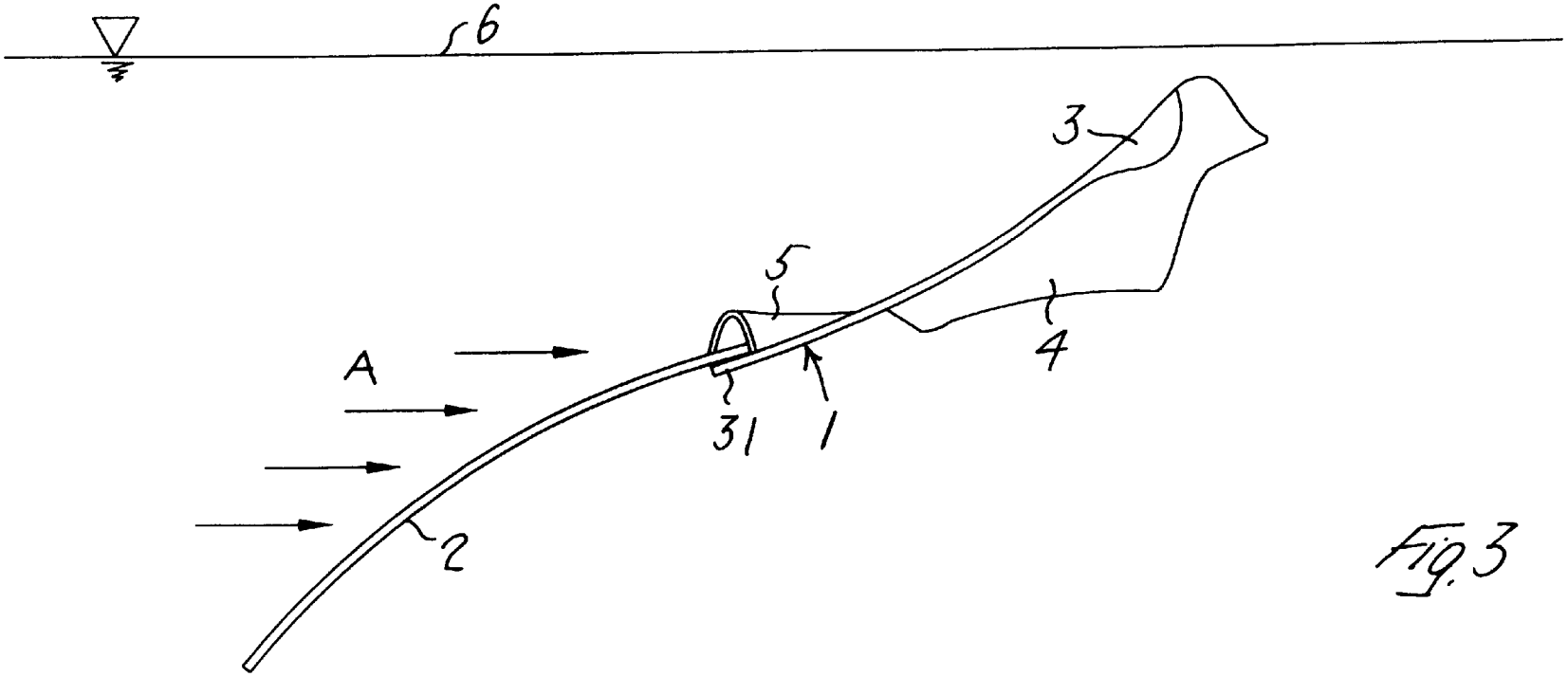
FIG. 3 shows the swimming flipper of FIG. 1 at the beginning of the active flipping down-up with respect to the water surface.

FIG. 3 shows the flipper 1 of the present invention in a position corresponding to the beginning of the diver's active flipping down-up with respect to the water surface 6 and, as can be observed, the flipper 1 is rather inclined with respect to said surface 6. The lower surface of the blade 2 acts onto the water mass, indicated by the arrows A, in touch with it, so as to ensure a good forward thrust for the scuba diver: in this situation, during said active flipping, the blade 2 moves integrally with the sole 3 of the shoe 4. As a matter of fact, its upper surface touches the hitting ends of the protruding elements 31 of said sole, whereas the flexible diaphragms, linking the blade 2 and some protruding elements 31, are in their rest position.

Figure 4:
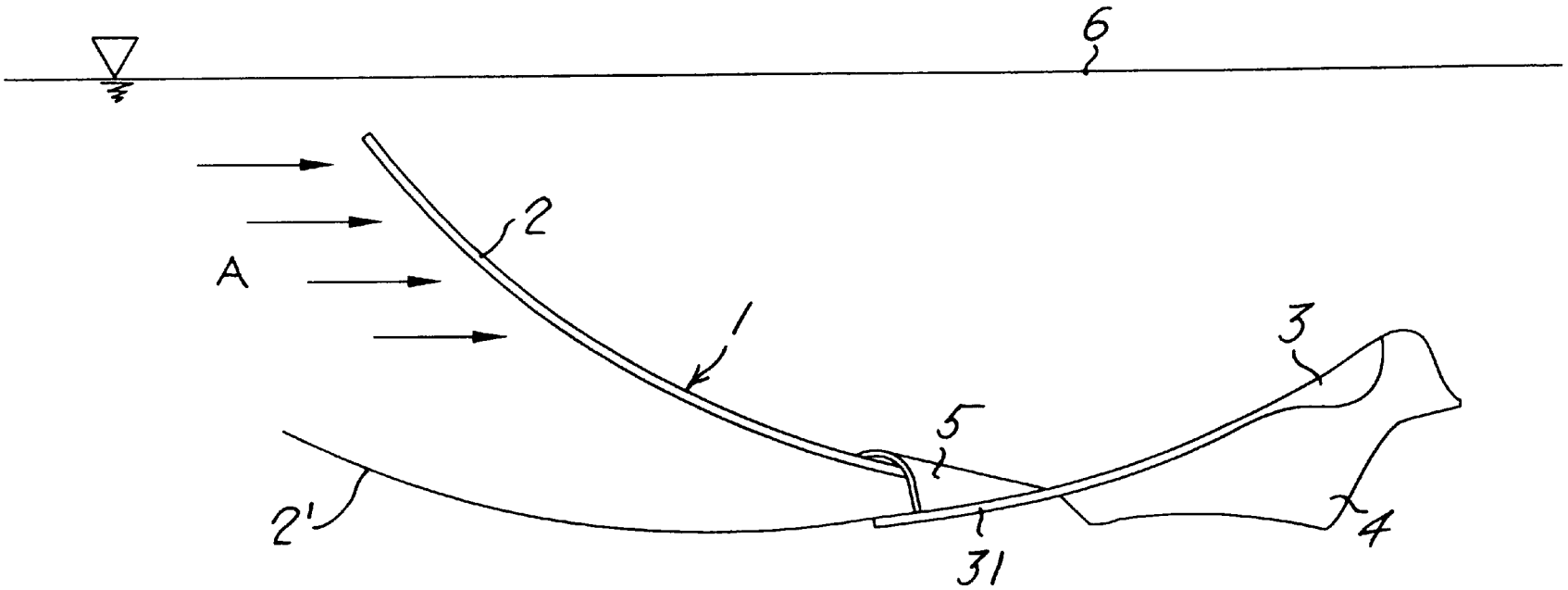
FIG. 4 shows the flipper of FIG. 3 at the beginning of the passive flipping up-down with respect to the water surface.

FIG. 4 shows the flipper 1 of FIG. 3 in a position corresponding to the beginning of the diver's passive flipping up-down with respect to the water surface 6. The flipper 1, as can be observed, is almost parallel to the water surface 6. In this case, during said passive flipping, the upper surface or back of the blade 2 acts onto the water mass, here again indicated by the arrows A, in touch with it. A blade 2' of a traditional swimming flipper follows the rotating movement of the sole 3, stiffly linked to said blade, and this movement shows a low efficiency from the dynamic point of view of the forward thrust, besides being rather hard for the scuba diver. According to the present invention, on the contrary, the blade 2, under the action of the water mass A acting on its back, rotates around the elastic joint 21 of a given angle, for instance 45°, and places itself in a position which is more advantageous and efficacious for the flipping movement, said rotation being limited by the flexible diaphragms 5, shown in their condition of maximum extension.

Figure 5:
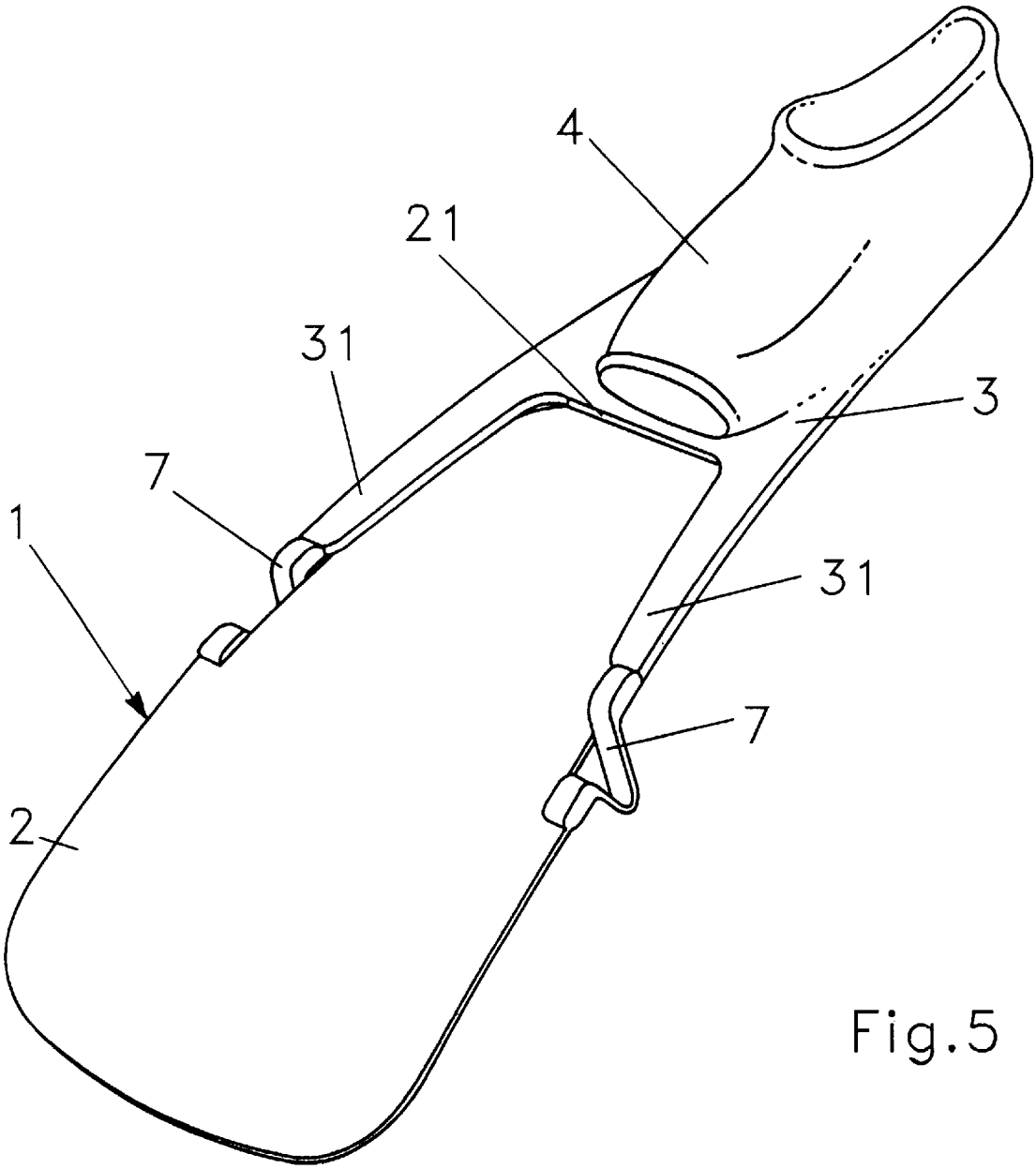
FIG. 5 is a perspective view of a second embodiment of the present invention with the blade support tie rods in rest position.
Figure 6:
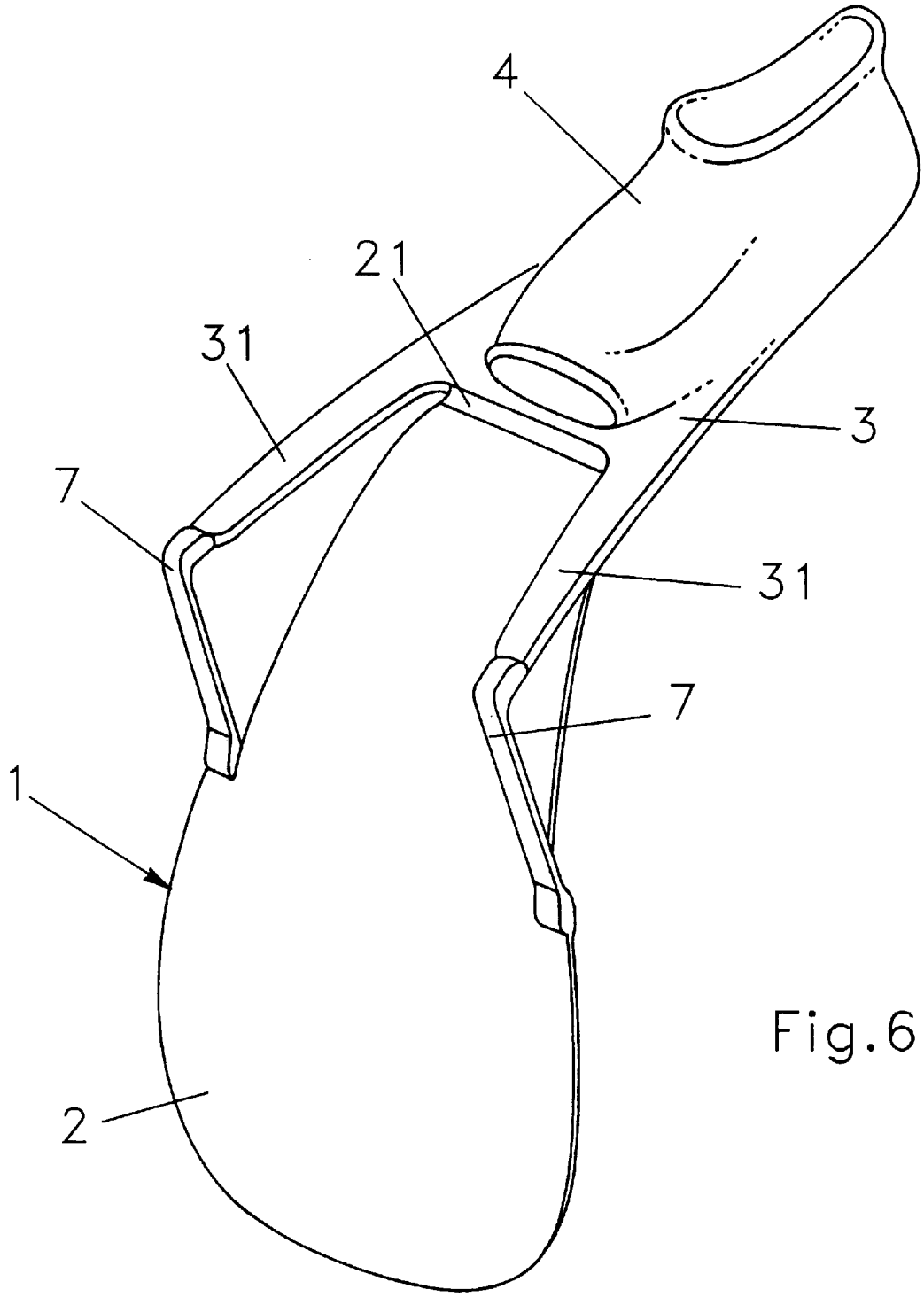
FIG. 6 is a perspective view of the embodiment of FIG. 5 with the tie rods in the position of maximum extension.

FIGS. 5 and 6 show a further embodiment of the swimming flipper 1. According to this embodiment the flexible diaphragms described above have been replaced by some flexible tie rods 7, which are shown in their rest position (FIG. 5) and in their condition of maximum extension (FIG. 6). Such tie rods 7 can be of elastomeric material or not, and they are connected on one side to the ends of the protruding elements 31 and on the other to the surface edge of the blade 2. Said tie rods 7 can be moulded together with the flipper 1 or they can be positioned later; moreover, if they are made of elastomeric material, they can include some stroke limit controls, not shown. In this form of embodiment the contact area for the upper surface of the blade 2 corresponds to the inside lateral edges of the protruding elements 31, placed near the base of said blade 2, and not to their ends, as for the form of embodiment described above. Obviously, the use of said tie rods 7 does not change the advantages of the use of the flexible diaphragms 5 according to the present invention.

Figure 7:
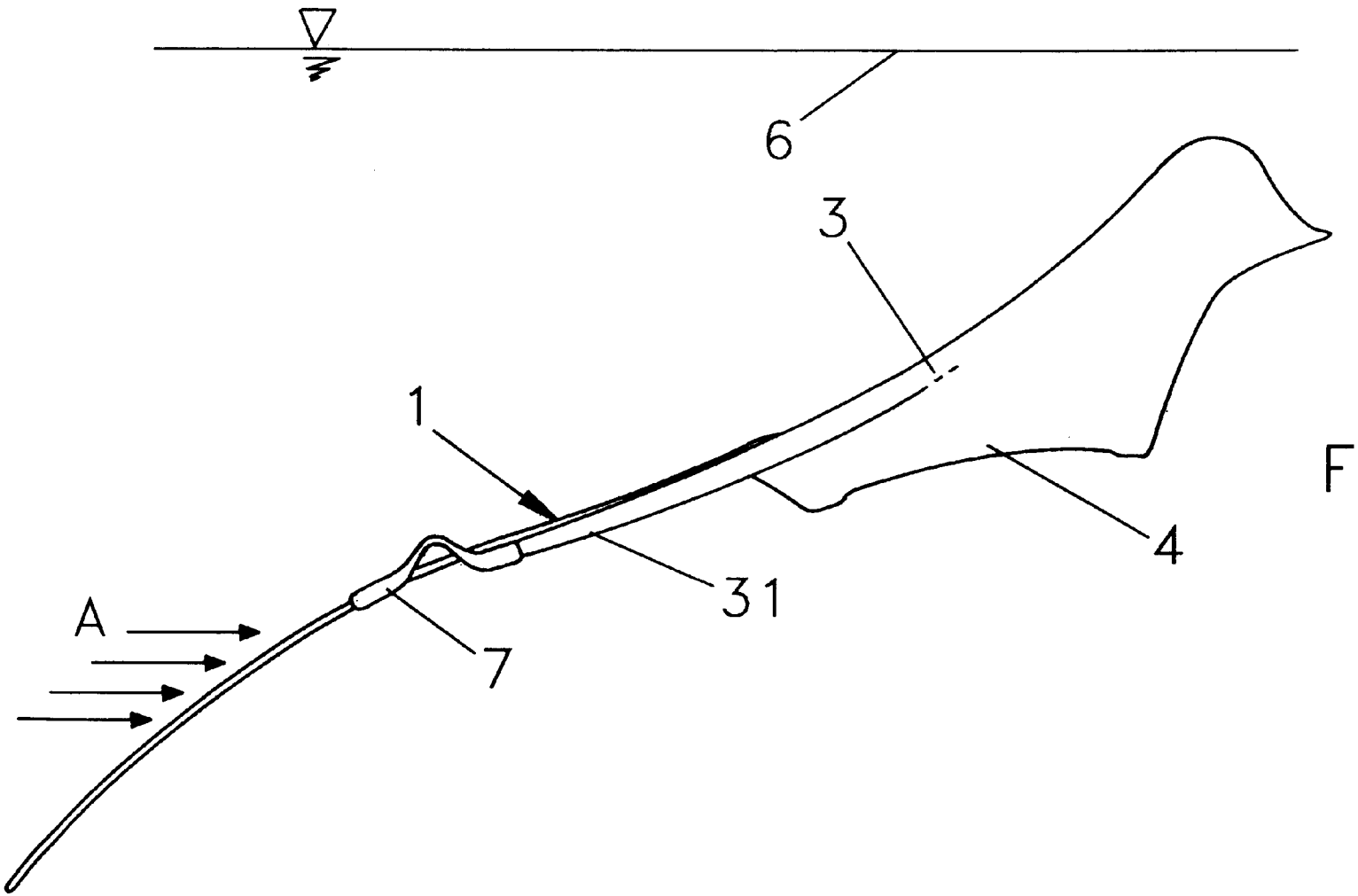
FIG. 7 shows the swimming flipper of FIG. 5 at the beginning of the active flipping going upwards with respect to the water surface.
Figure 8:
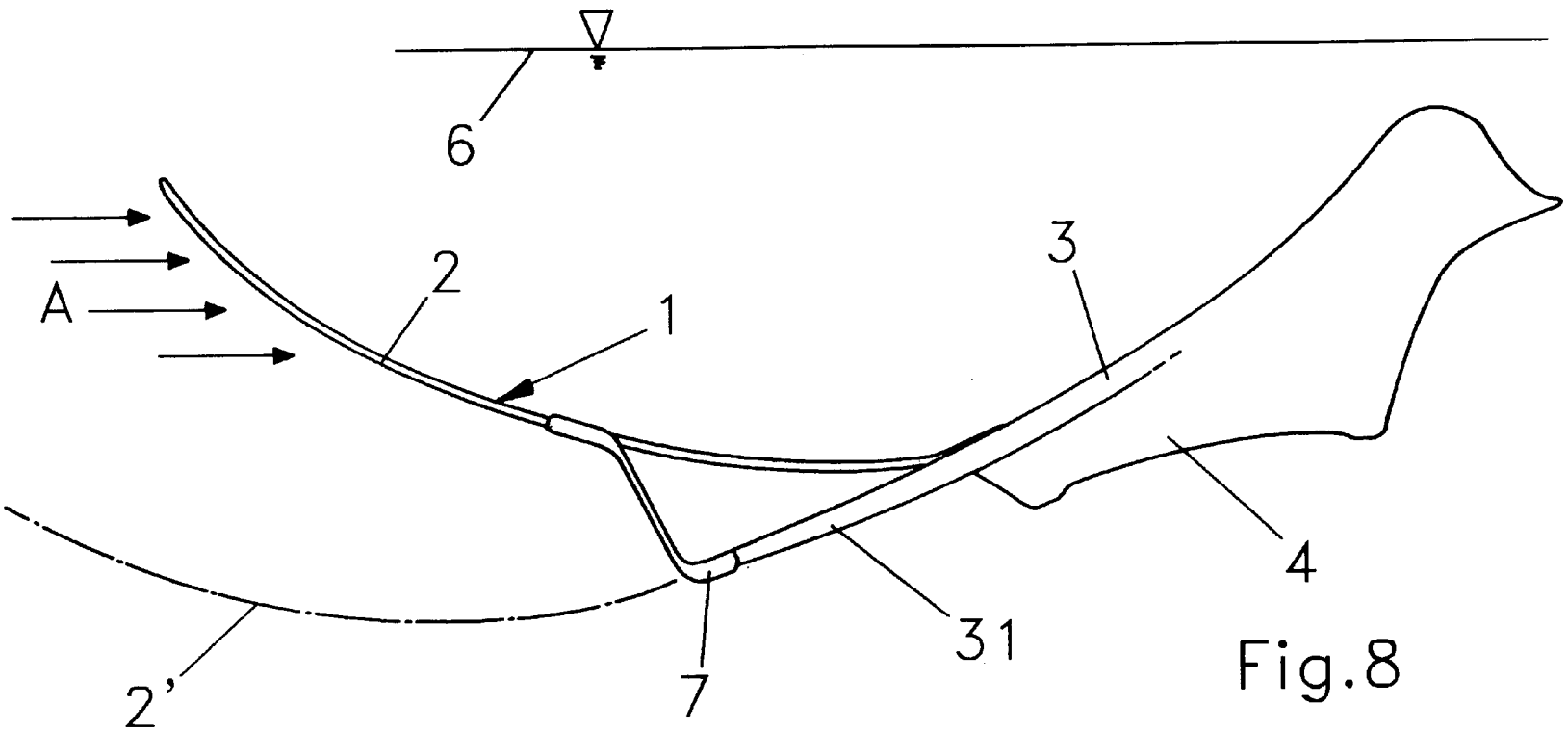
FIG. 8 shows the flipper of FIG. 5 at the beginning of the passive flipping going downwards with respect to the water surface.

The working of the blade 1 according to this embodiment using the tie rods 7 instead of the diaphragms 5, as can be observed from FIGS. 7 and 8, is very similar to what has been previously described for FIGS. 3 and 4. FIGS. 7 and 8 in fact show the action of the water mass A on the blade 2, respectively at the beginning of the diver's active flipping and at the beginning of the diver's passive flipping, with the advantageous inclination obtained by means of the maximum extension of the tie rods 7 supporting the blade 2 with respect to the inclination of a traditional blade 2'. The rotation of the blade 2 around the elastic joint 21 is limited by such maximum extension of the flexible tie rods 7, in the same way as for the flexible diaphragms 5.

Figure 9:
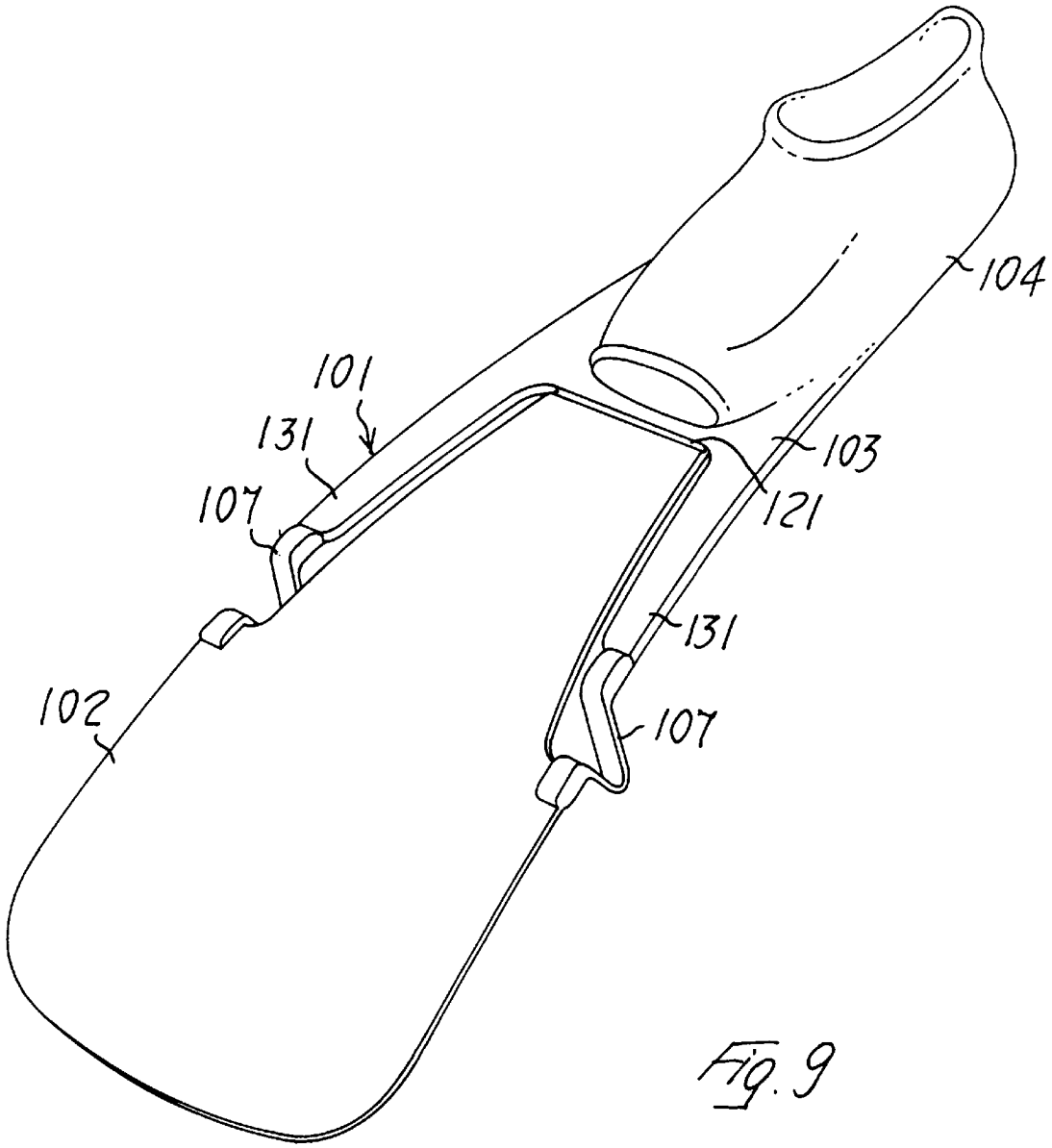
FIG. 9 is a perspective view of another embodiment of the swimming blade of the present invention with the extensible rods, for the side support between the blade and the projecting elements of the light shoe sole, in standing position.

In FIG. 9 a still further embodiment of a swimming flipper 101 according to the present invention is shown, which substantially includes a blade 102, a sole 103 and a shaped shoe 104. From the front part of the sole 103 project sideways two projecting elements 131. As one can see the projecting elements 131 form a wide, practically U-shaped, opening between them and the part of the sole 103 from which they project. To each of the lower surfaces of said projecting elements 131 are connected the first two ends of two supporting flexible rods 107, their other two ends being connected to the lower surface of the blade 102. Said blade 102, moreover, along the central zone of its root, is hinged to the sole 103 of the shoe 104 through a resilient joint 121, for instance of rubber or other elastomeric material.

Figure 10:
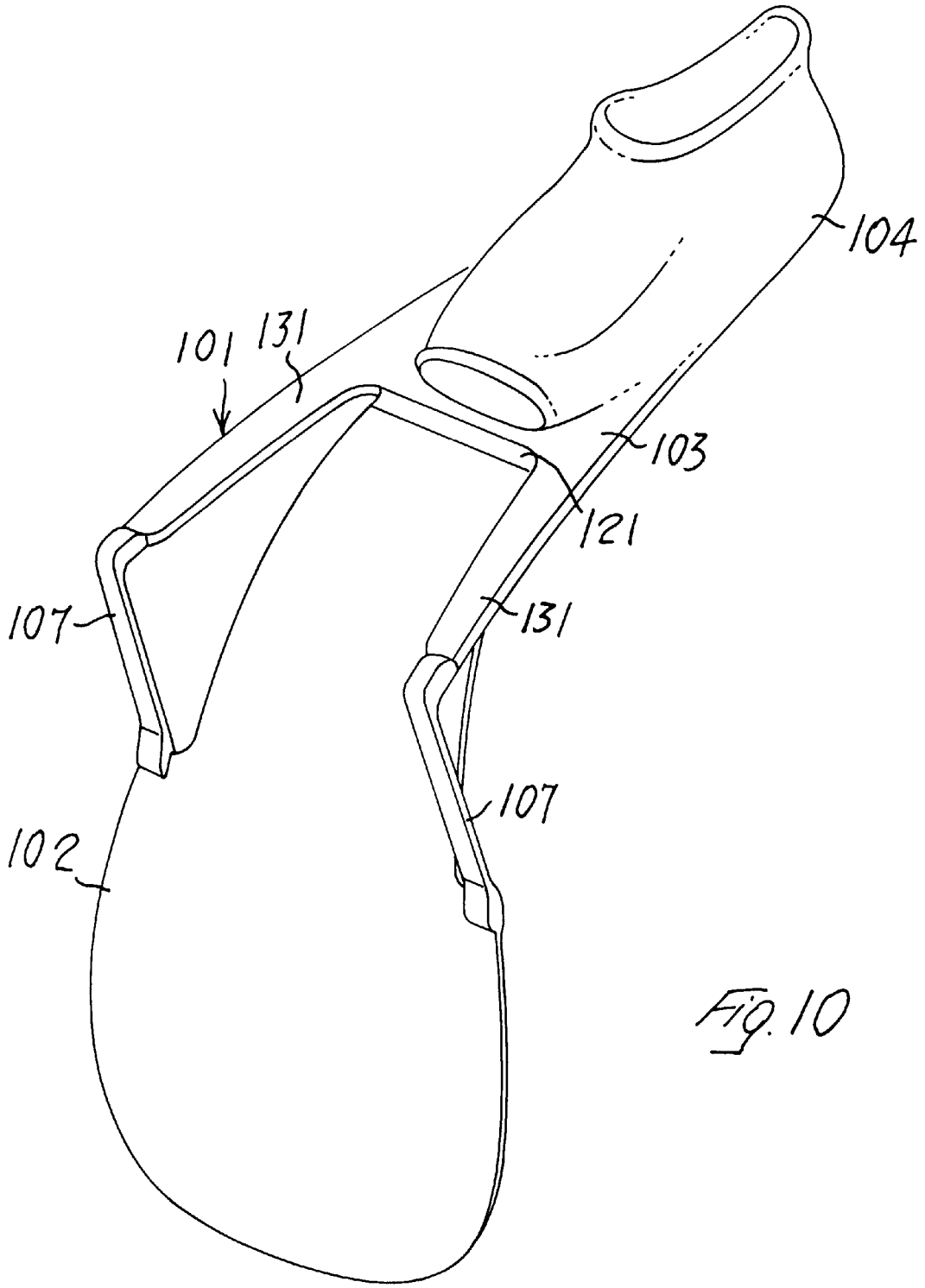
FIG. 10 is a perspective view of the embodiment of FIG. 9 with the rods in one of the position of maximum extension, and precisely at the beginning of the passive flippering.

These flexible rods 107, which in FIG. 10 are shown in the position of maximum extension at the beginning of the passive flippering, define the maximum rotation of the blade 102 with respect to the sole 103 of the shoe 104 and so the maximum deformation of the elastic joint 121: in fact the rotation arc described by the blade 102 as to the sole 103 shall not be too wide for not compromising the efficiency of the flipper 101 during the stage of the passive flippering. Said rods 107 can be molded integrally with the flipper 101 or positioned afterwards, and moreover, in case they are made of elastomeric material, they can include stroke limiting devices (not shown.)

Figure 11:
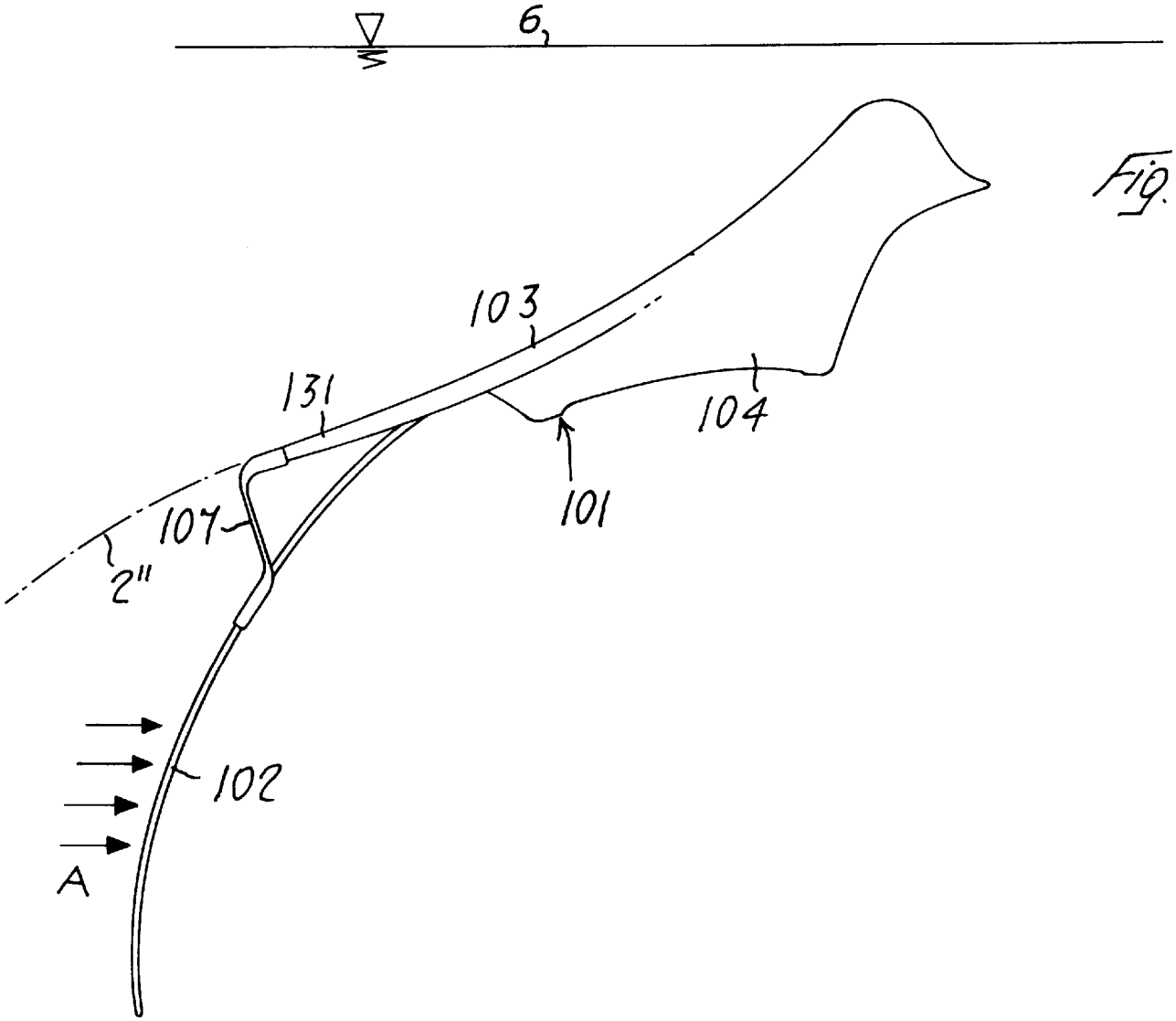
FIG. 11 shows the swimming flipper of FIG. 9 at the beginning of the active flippering from down to up as to the water surface.

In FIG. 11 the flipper 101 is shown in a position corresponding to the beginning of the active flippering by the diver from down to up as to the water surface 6 and as one can see the blade 102 of the flipper 101 is very inclined as to said surface 6, advantageously much more than a blade 2" of a conventional flipper. The lower surface of the blade 102 inclined in that way acts on the water mass, shown by the arrows A, in contact with it so to guarantee an optimal push forward to the diver and such inclination will be limited through the maximum extension of the rods 107.

Figure 12:
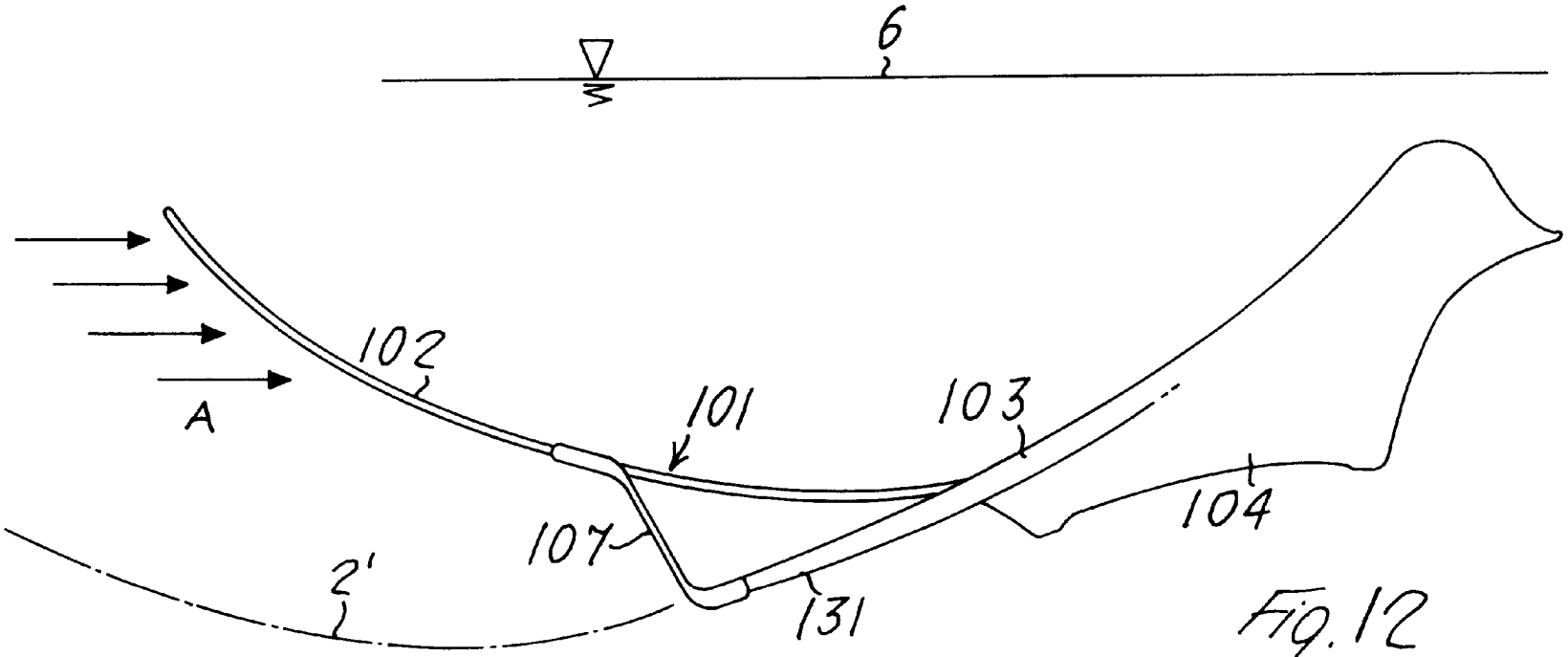
FIG. 12 shows the flipper of FIG. 11 at the beginning of the passive flippering from up to down as to the water surface.

In FIG. 12 is shown the flipper 101 of FIG. 11 in a position corresponding to the beginning of the passive flippering by the diver from up to down as to the water surface 6. As one can see the flipper 101 is practically parallel to the water surface 6. In this case during the passive flippering the upper surface or back of the blade 102 acts on the water mass, shown also here by the arrows A, in contact with it. A blade 2' of a conventional swimming flipper follows the rotatory movement of the sole 103 stiffly connected with it and this movement appears to be of little effectiveness from a dynamical point of view of the push forward as well as very hard for the diver. According to one aspect of the present invention, on the contrary, the blade 102, under the action of the water mass A which acts on its back, rotates around the elastic joint 121 of a certain angle, for instance 45°, and arranges itself in a position much more advantageous and effective for the flippering, being said rotation limited through the flexible rods 107 shown in the position of maximum extension.

Figure 13:
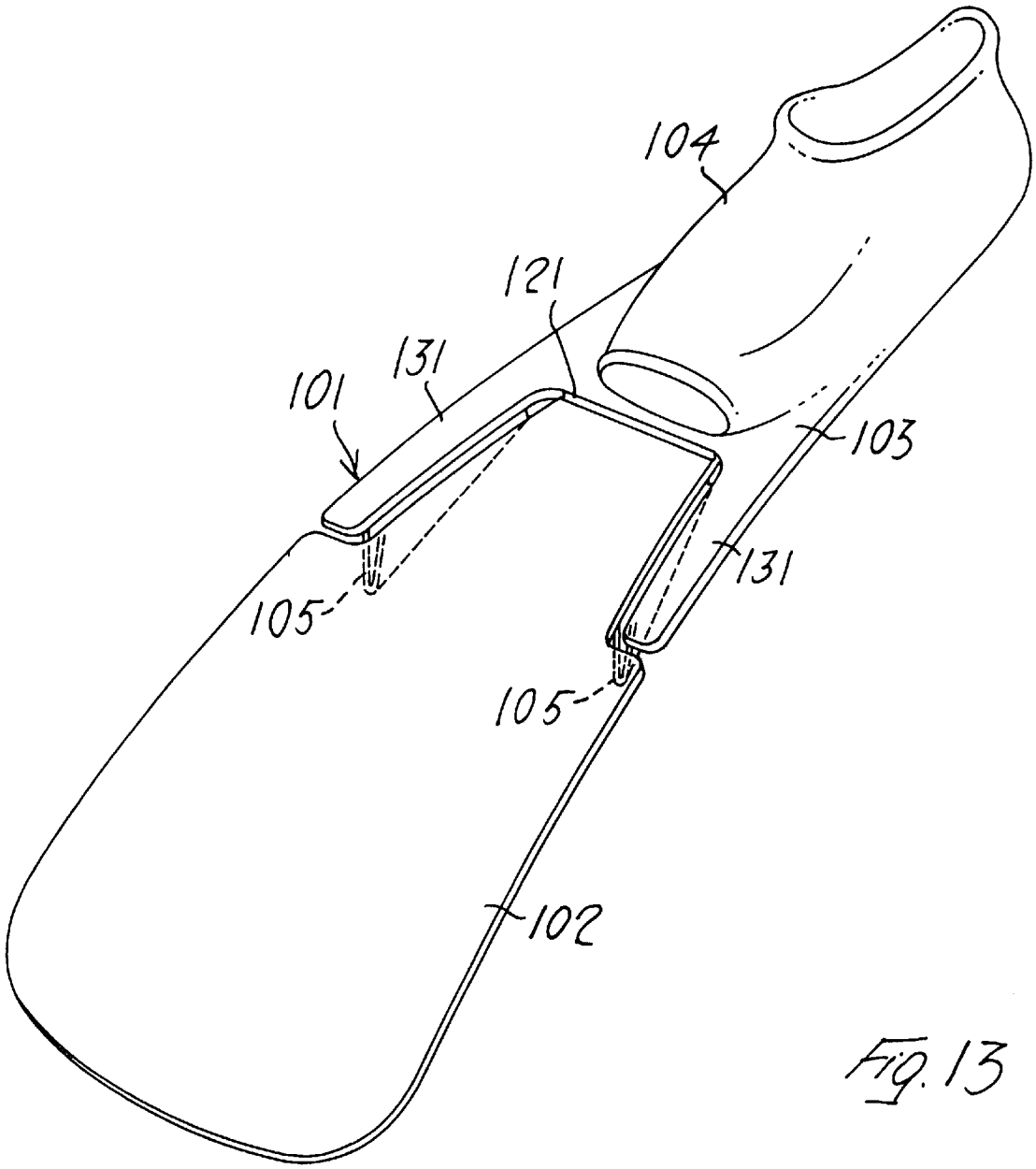
FIG. 13 is a perspective view of still another embodiment of the present invention with the flexible membranes of the blade in stand position.
Figure 14:
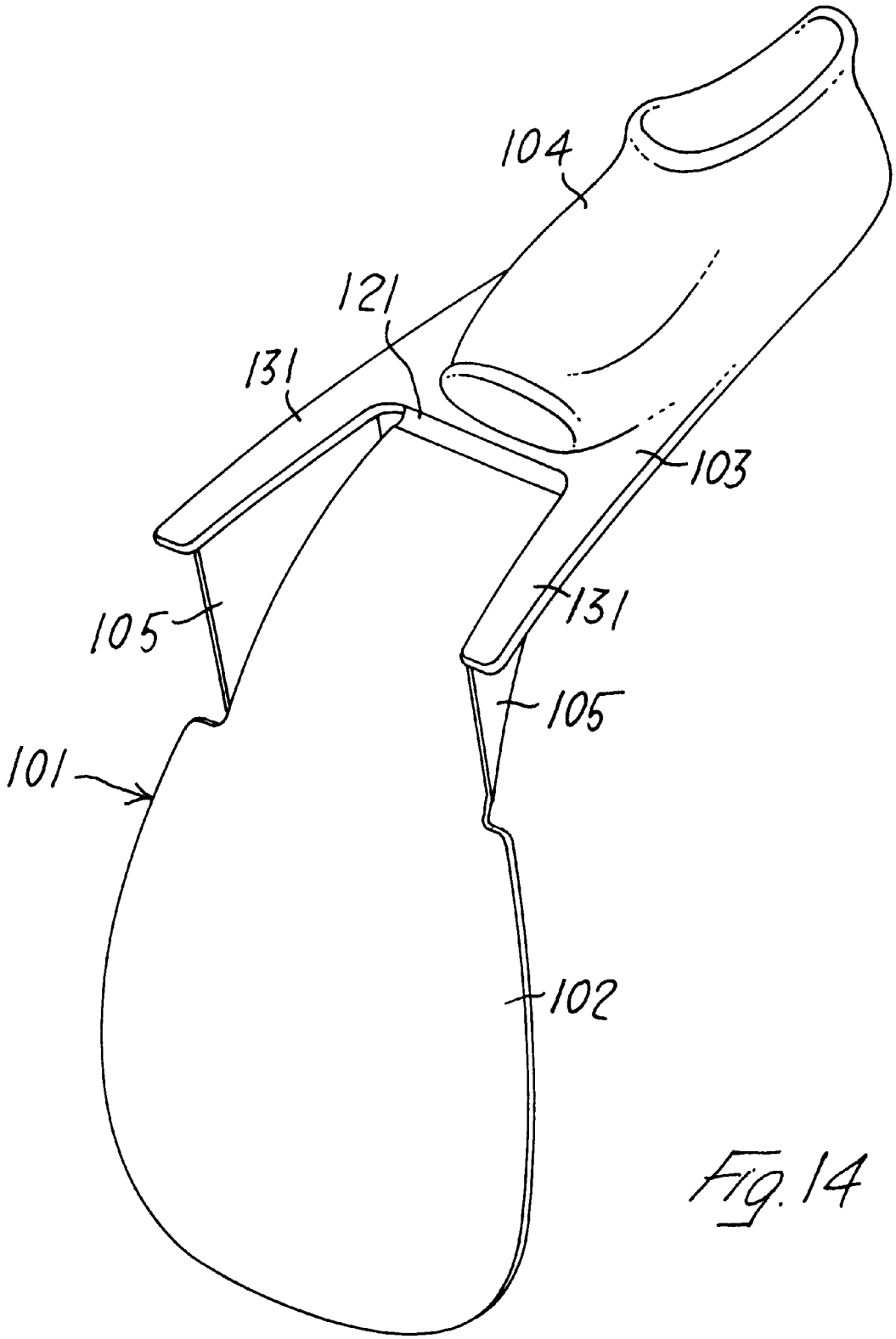
FIG. 14 is a perspective view of the embodiment of FIG. 13 with the membranes in one of the positions of maximum extension and precisely at the beginning of the passive flippering.

In FIGS. 13 and 14 is shown a further embodiment of the swimming flipper 101. According to this embodiment the previously described flexible rods 107 have been replaced by flexible membranes 105, which are shown in the stand position (FIG. 13) and in the position of maximum extension at the beginning of the passive flippering (FIG. 14). Such membranes 105 can be made of elastomeric material and are connected on one side to the ends of the projecting elements 131 and on the other side to the edge of the surface of the blade 102. According to one aspect of the present invention said elastic joint 121 and said flexible membranes 105 are obtained by injection molding of the same material forming the shoe 104, which can be for instance an elastomeric material, such as rubber or else.

The use of said membranes 105 naturally let unchanged the advantages provided by the rods 107 previously described and the functioning of the flipper 101 is completely like the one previously described with reference to the FIGS. 11 and 12.

We claim:

1. Swimming flipper comprising a shoe made of a relatively soft material and provided with a sole and with a blade made of a stiffer material, said shoe being sidewise and frontwise provided with at least two protruding elements, said blade being hinged to said sole of the shoe by means of a resilient joint element in an area between said protruding elements, and being further connected to said protruding elements by means of two extensible stroke-limiting elements.

2. Swimming flipper according to claim 1, in which said protruding elements are suitable to hit against the upper surface of the blade, the whole so that:

in a passive flipping up-down with respect to the water surface, said blade rotates with respect to the sole of the shoe under the action of the water mass touching the back of said blade, said rotation being limited by a maximum extension of said extensible elements;

in an active flipping down-up with respect to the water surface, said blade moves integrally with the sole of the shoe, said blade being kept in position against the sole of the shoe by means of said contact of the ends of the protruding elements against the upper surface of the blade and said elements being in their rest position.

3. Swimming flipper according to claim 1, in which said protruding elements form, with the portion of sole from where they protrude, a wide opening substantially U-shaped.

4. Swimming flipper according to claim 1, in which said extensible elements are flexible diaphragms connecting the lower surface of said protruding elements to the lower surface of said blade near its base.

5. Swimming flipper according to claim 1, in which said extensible elements are flexible tie rods connecting the ends of said protruding elements to the confronting edges of said blade.

6. Swimming flipper according to claim 5, in which said tie rods are obtained by injection of the material of the shoe.

7. Swimming flipper according to claim 1, in which said resilient joint is obtained by injection of the material of the shoe.

8. Swimming flipper according to claim 1, in which said extensible elements are flexible membranes connecting the lower surfaces of said projecting elements with the lower surface of said blade near its root.

9. Swimming flipper according to claim 1, in which said extensible elements are flexible rods connecting the ends of said projecting elements with the edge of said blade positioned near said ends.

* * * * *